US006311863B1

(12) United States Patent
Fleming

(10) Patent No.: US 6,311,863 B1
(45) **Date of Patent: *Nov. 6, 2001**

(54) VAPOR DIRECTING BEVERAGE CONTAINER

(76) Inventor: Douglas H. Fleming, 4126 Ashworth Ave. N., Seattle, WA (US) 98103

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/730,483

(22) Filed: Oct. 11, 1996

(51) Int. Cl.[7] ..... B65D 23/00

(52) U.S. Cl. ..... 220/713; 220/714; 220/719; 220/501; 220/367.1

(58) Field of Search ..... 220/719, 713, 220/714, 563, 501, 367.1

(56) References Cited

U.S. PATENT DOCUMENTS

| | | | | |
|---|---|---|---|---|
| 2,358,600 | * | 9/1944 | Selten | 220/719 |
| 2,362,354 | * | 11/1944 | Clovis | 220/719 |
| 3,360,161 | * | 12/1967 | Smith | 220/719 |
| 3,400,855 | * | 9/1968 | Alexander | 220/719 |
| 3,938,695 | * | 2/1976 | Ruff | 220/90.4 |
| 4,085,861 | * | 4/1978 | Ruff | 220/90.4 |
| 4,586,625 | * | 5/1986 | Garrett | 220/266 |
| 4,589,569 | * | 5/1986 | Clements | 220/380 |
| 4,609,124 | * | 9/1986 | Malloy | 220/260 |
| 4,619,372 | * | 10/1986 | McFarland | 220/90.4 |
| 4,768,674 | * | 9/1988 | Prescott | 220/90.4 |
| 4,938,377 | * | 7/1990 | Jarvis | 220/719 |
| 5,370,258 | * | 12/1994 | Fair | 220/719 |
| 5,540,350 | * | 7/1996 | Lansky | 220/380 |
| 5,542,670 | * | 8/1996 | Morano | 220/719 |

FOREIGN PATENT DOCUMENTS

| | | | | |
|---|---|---|---|---|
| 502009 | * | 3/1939 | (GB) | 220/719 |

* cited by examiner

*Primary Examiner*—Joseph M. Moy
(74) *Attorney, Agent, or Firm*—R. Reams Goodloe, Jr.

(57) ABSTRACT

A covered beverage container with an internal baffle which forces aroma laden vapor between the lid and the beverage in the container out openings in the lid when the container is tipped from the level position to the drinking position, thereby allowing the user to more fully enjoy the aroma of the beverage.

8 Claims, 5 Drawing Sheets

VAPOR DIRECTING BEVERAGE CONTAINER

FIELD OF THE INVENTION

The present invention relates to covered beverage containers including single use paper and plastic cups and lids as well as reusable plastic, metal and/or ceramic covered beverage containers, and, more particularly, to a covered beverage container that directs beverage vapor in a predetermined direction. Such containers are typically used for coffee, tea and soft drinks. Such containers allow the aroma of the beverage to be enjoyed while drinking from a container while the cover or lid of the container remains on, thereby reducing the risk of spilling and, for hot beverages, retaining the heat of the beverage.

BACKGROUND OF THE INVENTION

It is well known that the aroma of a beverage comprises a large part of the flavor of the beverage. While the taste buds sense only sweet, salt, sour and bitter, the nose can distinguish between approximately 10,000 distinct odors.

Typically, covered beverage containers sacrifice to a significant degree the aroma of the beverage when the beverage is drunk while the lid of the container remains in place. Other covered beverage containers allow for aroma laden air vapor to travel through drink openings or other small openings for venting air.

However, because the vast majority of the container must remain covered in order to achieve the benefits of a lid (such as reduced risk of spilling and retaining the heat of hot beverages), traditional lidded beverage containers have resulted in far less of the aroma laden air from the beverage reaching the nostrils of the drinker.

SUMMARY OF THE INVENTION

In accordance with the present invention, a vapor directing beverage container comprises a lidded beverage container with an internal baffle. The lid has a drink opening to allow beverage to pass through the lid while the lid remains attached to the container and at least one vent opening in addition to the drink opening to allow vapor within the container to pass through the lid. The baffle is sized and shaped so that when it is inserted into the container, the baffle seals against the container side walls and extends down into the container so that the bottom of the baffle is near to the bottom of the container. The space between the bottom of the baffle and the bottom of the container allows liquid in the container to flow freely from one side of the baffle to the other side of the baffle. The baffle sealably attaches to the lid of the container and is further positioned between the drink opening and the vent opening so as to divide the space within the container into two chambers. When the container is tipped to allow beverage to flow out the drink opening, vapor within one chamber is forced out openings in the lid while air from outside the container is simultaneously drawn into the container through openings on the other side of the baffle. The precise location and shape and number of the openings through which vapor is directed can vary depending upon the size and shape of the lid and container in order control the direction and speed of the vapor.

In accordance with the present invention, a covered beverage container is provided for pumping vapor from within the container to the vicinity of the user's nose when the container is tipped from the level position to the drinking position or from the drinking position back to the level position.

In accordance with another aspect of the present invention, the beverage container includes a lid through which beverage can be drunk with the lid still in place, thereby reducing the amount of spillage from the container and retaining the heat of a hot beverage while the container remains at rest.

An important feature of the present invention is a baffle that, when the container is tipped, allows the rising liquid level in one half of the container to force vapor out openings in the lid towards the user's nose.

An important advantage of the present invention is that it provides a new mechanism beyond volatilization by which the aroma of the beverage can be enjoyed by the user.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
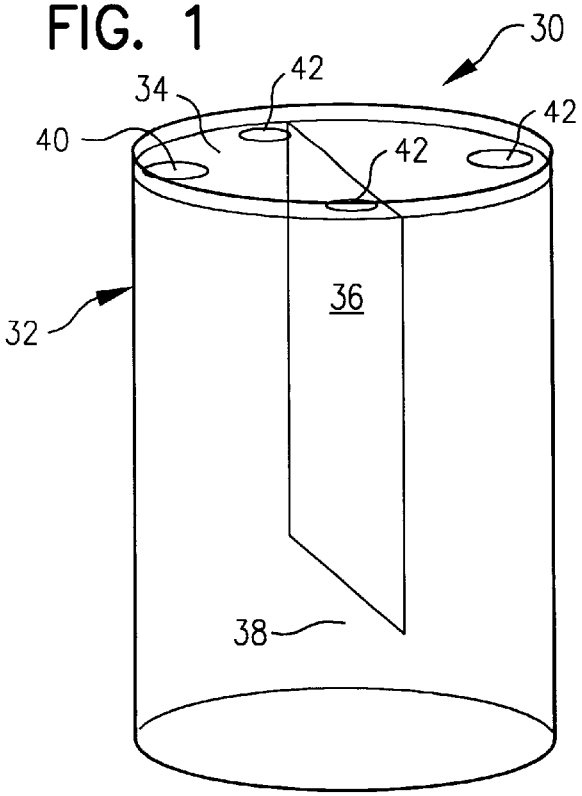
FIG. 1 shows the side view of a simple vapor directing beverage container with a vertical baffle formed in accordance with the present invention.
Figure 3:
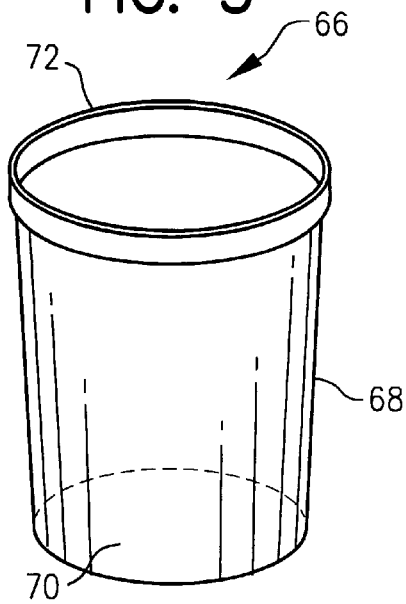
FIG. 3 shows a disposable cup.

Referring now to the drawings, FIG. 1 exemplifies a simple representation of the invention. The vapor directing beverage container 30 includes a container 32 with a closure lid 34 sealed to the rim of the container 32. A baffle 36 seals against the lid 34 and the side walls of the container 32. A gap 38 between the bottom of the container 32 and the bottom edge of the baffle 36 allows liquid in the container 32 to flow freely from one side of the baffle 36 to the other side. The lid 34 has a drink opening 40 and vent openings 42.

Figure 2:
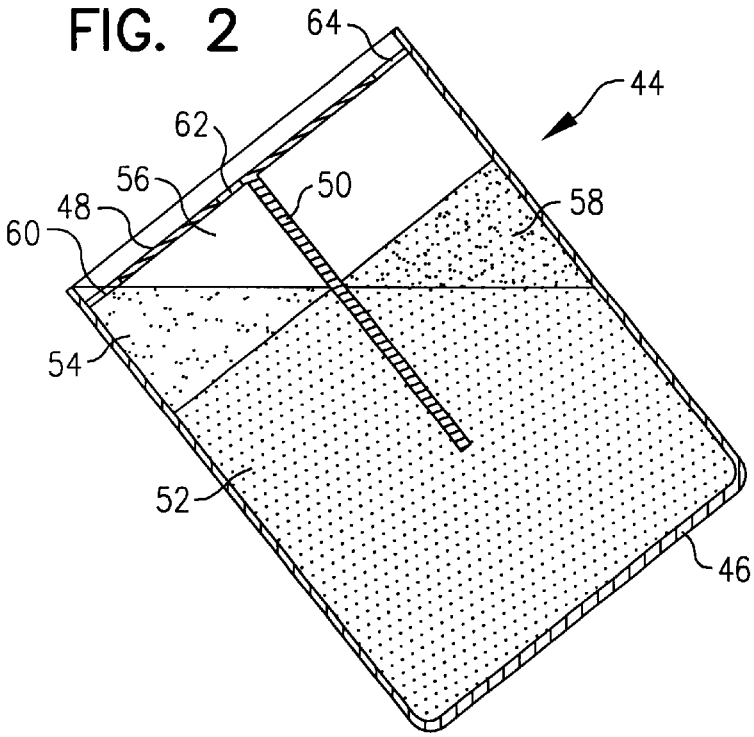
FIG. 2 shows a schematic of the effect created by tipping a vapor directing beverage container.

FIG. 2 shows a simplified two-dimensional schematic of the vapor directing beverage container 30, which is shown in FIG. 1, where the container 46 with a lid 48 and a baffle 50 has been tipped to the drinking position so that the beverage may be drunk through the drink opening 60. The liquid in container 46 is represented by the shaded areas 52 and 54. In a level position the same volume of liquid in the container 46 would occupy the shaded areas 52 and 58. As the container 46 is tipped from the level position to the drinking position, the air volume 56 decreases. The vapor in area 54 is forced out the drink opening 60 and vent opening 62. When the container 46 is tipped back to the level position, the vapor in area 58 is forced out vent opening 64.

FIG. 3–FIG. 7 depict one of the alternative embodiments of the present invention. The container 66 is of any conventional configuration and construction including disposable cups of the type commonly used as carry out containers for beverages such as coffee and tea. Typically, the container 66 has downwardly converging side walls 68 and a bottom 70 so that the container 66 is an inverted frusto-conical shape. The container 66 may be fabricated from any number of materials including wax or resin impregnated paper, Styrofoam, plastic sheet or paperboard. The container typically has a bead formed on the rim 72 to facilitate attachment of a lid.

Figure 4:
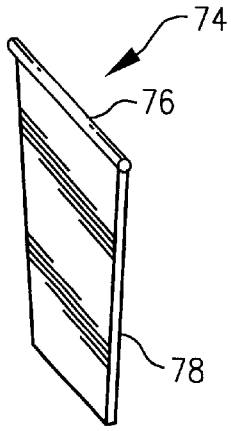
FIG. 4 shows a disposable baffle.
Figure 5:
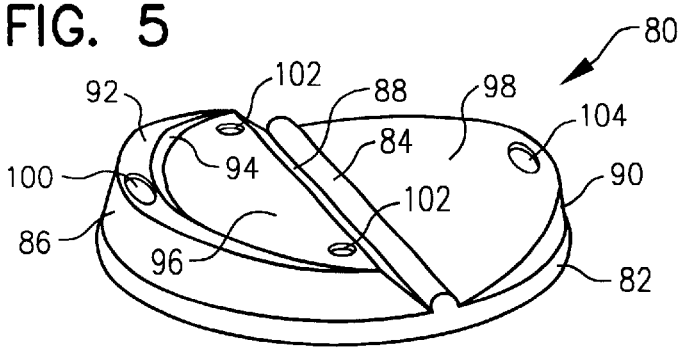
FIG. 5 shows a disposable lid.
Figure 6:
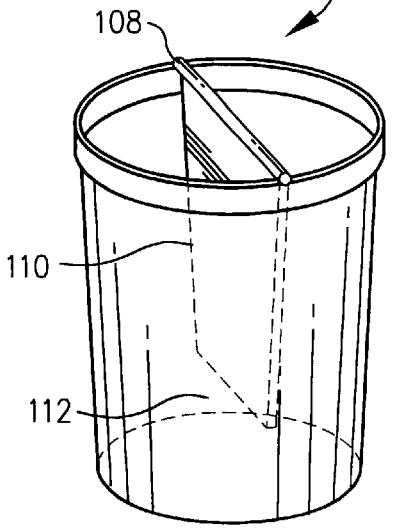
FIG. 6 shows the baffle of FIG. 4 inserted into the cup of FIG. 3.

The baffle 74 depicted in FIG. 4 is sized and shaped to slidably fit into the container 66, as depicted in FIG. 6. The baffle 74 may be fabricated from any number of materials including wax or resin impregnated paper, Styrofoam, plastic sheet or paperboard. The baffle 74 is topped with a bead 76 so that when the baffle 74 is inserted into the container 66, the rim 72 of the container 66 and the bead 76 of the baffle 74 form a continuous edge 108 to which the lid 80, depicted in FIG. 5, can be sealably attached. When the baffle 74 is inserted into the container 66, the baffle 74 frictionally seals against the side wall 68 of the container 66 so that neither air nor liquid will leak through the joint 110. The baffle side 78 is shorter than the container side wall 68 so that a gap 112 is created between the bottom of the baffle 74 and the bottom of the container 66 when the baffle 74 is fully inserted into the container 66.

Figure 7:
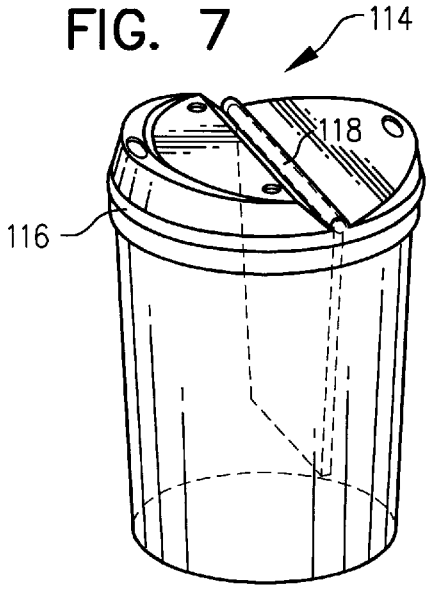
FIG. 7 shows the lid of FIG. 5 attached to the cup/baffle assembly of FIG. 6.
Figure 8:
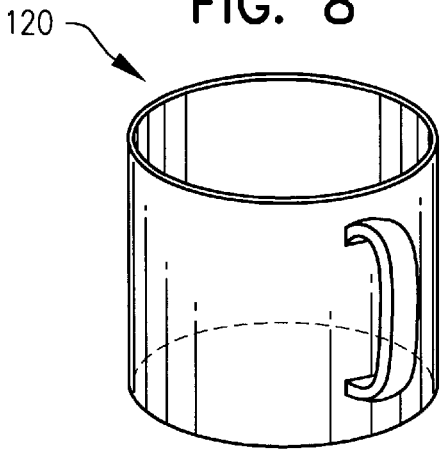
FIG. 8 shows a ceramic cup with handle.

FIG. 5 depicts a lid 80, which covers the container 66. The lid 80 includes a recessed rim 82, which releasably attaches to the rim 72 of the container 66. The lid 80 also includes a grove 84, which engages the bead 76 of the baffle 74. When the baffle 74 is inserted into the container 66, as depicted in FIG. 6, and the lid 80 is attached to the baffle/container assembly 106, as depicted in FIG. 7, an air and water tight seal (116 and 118) is created between the container 66 and lid 80 and the baffle 74 and lid 80.

The lid 80 includes a tapering annular side wall 90 that extends upwardly from the recessed rim 82, and a large top wall 98 having a generally circular periphery adjoining the side wall 90 and sloping down to the groove 84. The top wall 98 has an opening 104 adjacent to the periphery of the top wall 98, which allows vapor to pass through the lid 80. The lid 80 also includes an annular side wall 86 that extends upward from the recessed rim 82, and a groove side wall 88 that extends upward from the grove 84. A small top wall 96 adjoins the groove side wall 88 and has vent openings 102 near the edge where the small top wall 96 joins the groove side wall 88. A drink opening top wall 92 adjoins the side wall 86 and has a drink opening 100. The tapering annular side wall 94 depends downward from the drink opening top wall 92 and adjoins the small top wall 96. The side wall 86, drink opening top wall 92, and tapered annular side wall 94 are configured to allow the lips of the user to comfortably fit around the area of the drink opening 100.

The lid is frusto-conical in shape (i.e., all angles are less than 90 degrees), which allows it to be constructed of a single piece of vacuum formed plastic and also allows multiple lids to be stacked for storage and shipment.

Figure 9:
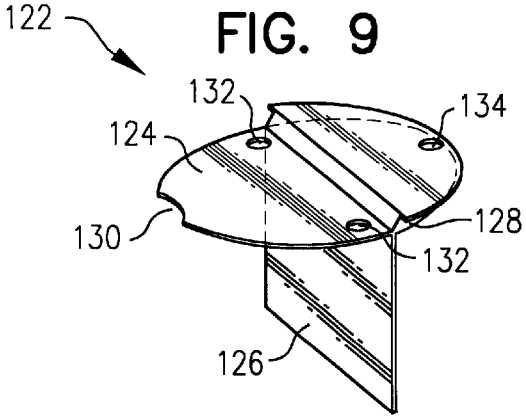
FIG. 9 shows a vapor directing cup insert with a vertical baffle.
Figure 11:
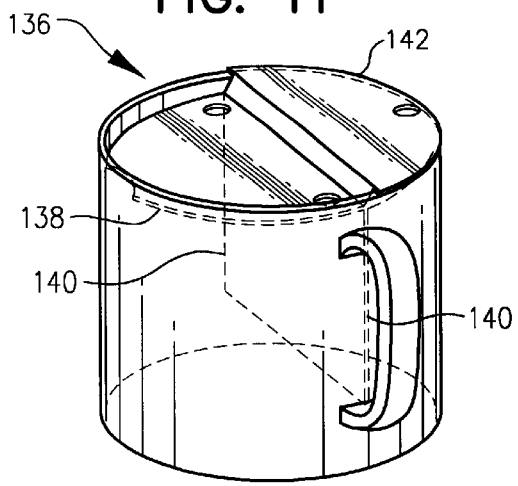
FIG. 11 shows the insert of FIG. 10 inserted into the cup of FIG. 8.

FIG. 8–FIG. 11 depict other alternative embodiments of the present invention. The cup 120 can be any conventional configuration including the common ceramic mug with a handle which is often used for drinking coffee and tea. FIG. 9 depicts a cup insert 122, which may be constructed from a single piece of injection molded plastic or from other relatively inexpensive materials such as ceramic, metal, wood, or paper. The cup insert 122 comprises a slopped circular top wall and a vertical baffle member 126 that adjoins the top wall 124 at or near the top wall 124 diameter and extends perpendicularly downward. The outer circular rim 138 and the edges 140 of the baffle 126 frictionally engage the inner side wall of the cup 40 when the cup insert 122 is inserted into the cup 40 to create the cup/insert assembly 136, as depicted in FIG. 11. The outer rim 138 of the top wall 124 and edges 140 of the baffle 126 include a gasket or flap which is preferably but not necessarily made out of the same material as the rest of the cup insert 122 but is thinner so as to be more flexible in order to assist in obtaining a air and water tight seal and to allow a single sized cup insert 122 to fit slightly different diameter cups. The slopping circular top wall 124 has a drink notch 130 at the lowest point when the cup insert 122 is inserted into the cup 120. The top wall 124 also includes vent openings 132 on the same side of the baffle member 126 as the drink notch 130 that are near to where the baffle member 126 joins the top wall 124. The top wall also includes a vent opening 134 that is on the opposite side of the baffle member 126 from the drink notch 130. The precise size, shape, location and number of the vent openings 132 and 134 may vary depending upon the size and shape of the cup 120. However, there must always be at least one vent opening 134, which allows the air pressure within the cup 120 to equalize when the cup 120 is tipped to the drinking position and back to the level position. Vent openings should also be located so that the beverage will not spill out of the vent openings when the cup is tipped to the drinking position. The cup insert 122 also includes a tapered side wall 128 which extends upward from the top wall 124 from that portion of the top wall rim that is on the opposite side of the baffle 126 from the drink notch 130. The rim 142 of the side wall 128 contains a bead or lip which prevents the cup insert 122 from being pushed too far into the cup 120. As depicted in FIG. 11, the rim 142 allows the insert to easily be inserted into and removed from the cup 120 and insures that the cup insert 122 is properly positioned in the cup 120 when the insert 122 is pushed into the cup 120 until the rim 142 rests against the lip of the cup, as shown in FIG. 11.

Figure 10:
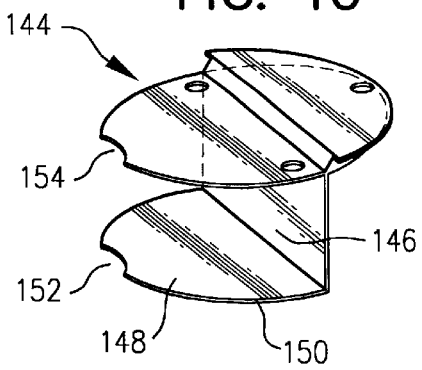
FIG. 10 shows a vapor directing cup insert with a vertical and horizontal baffle.

The cup insert embodiment 144 depicted in FIG. 10 is identical to the embodiment 122 depicted in FIG. 9 except that the vertical portion 146 of the baffle is shorter and the baffle has a horizontal portion 148 extending in a half circle from the bottom of the vertical portion 146. The edge 150 of the horizontal portion 148 of the baffle frictionally engages the inner side wall of the cup 120 in the same manner as the edges of the vertical portion 146 of the baffle frictionally engage the side wall of the cup 120. The horizontal portion 148 of the baffle has a notch 152, which allows air and liquid to pass between the horizontal portion 148 of the baffle and the side wall of the cup 120.

Figure 12:
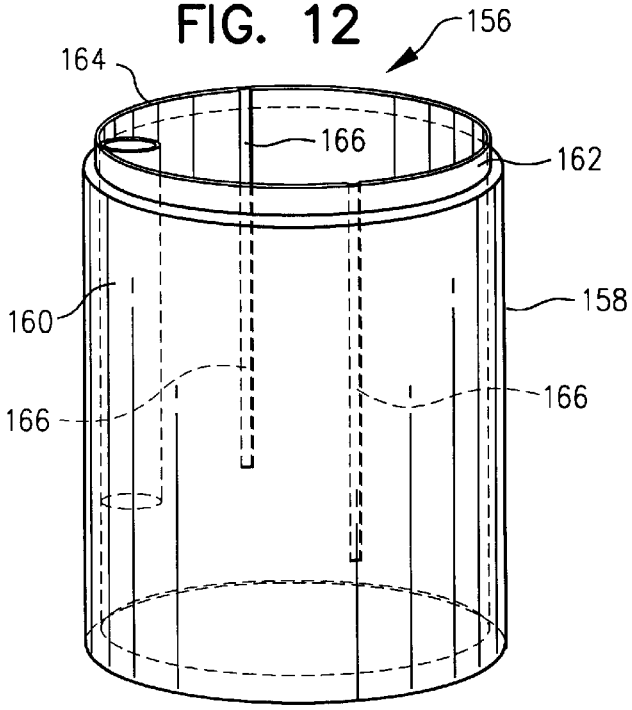
FIG. 12 shows a reusable beverage cup with grooves for a vertical baffle.
Figure 13:
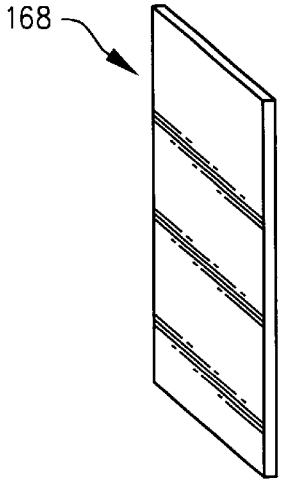
FIG. 13 shows a vertical baffle.
Figure 14:
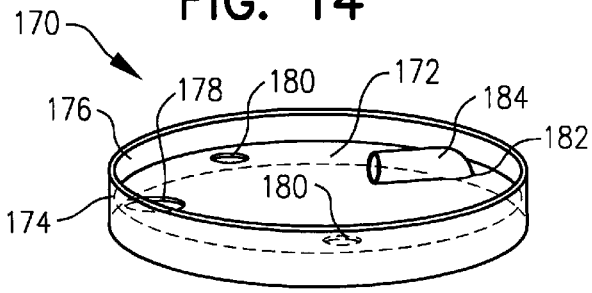
FIG. 14 shows a reusable lid.
Figure 15:
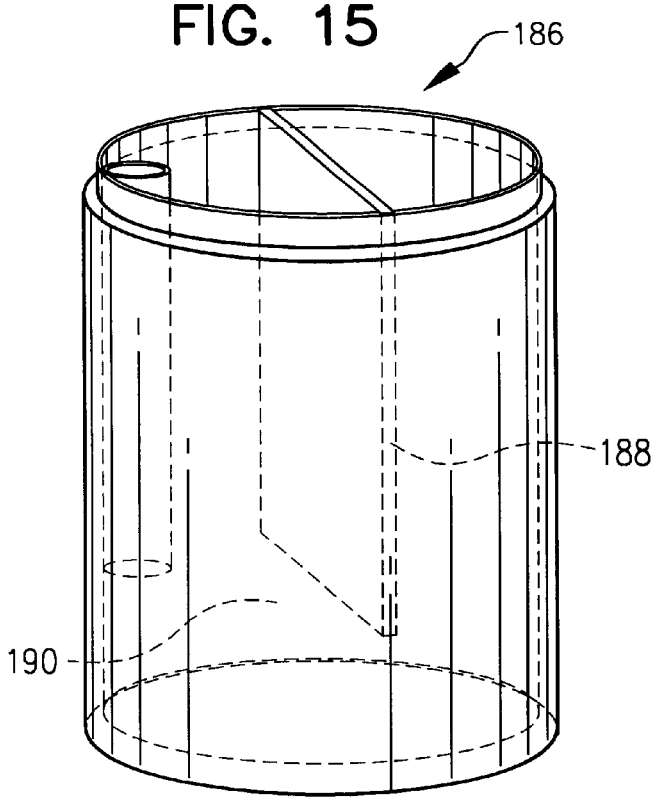
FIG. 15 shows the baffle of FIG. 13 inserted into the cup of FIG. 12.
Figure 16:
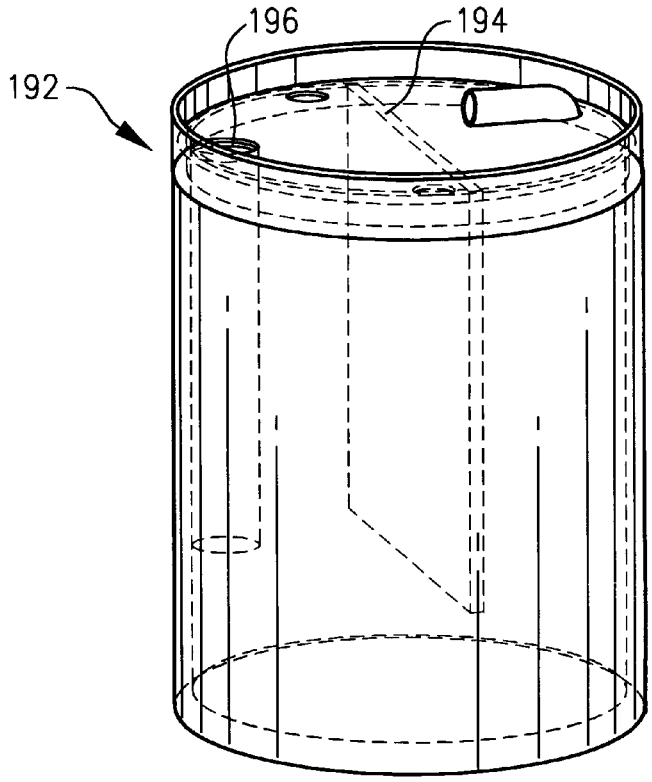
FIG. 16 shows the lid of FIG. 14 attached to the cup/baffle assembly of FIG. 15.

FIG. 12 through FIG. 16 depict another alternative embodiment of the present invention. The container 156, depicted in FIG. 12, is a reusable beverage cup, typically constructed of plastic or aluminum. The container 156 has a neck 162 which has threading or similar features which allow the lid 172, depicted in FIG. 14, to removably attach to the container 156, as depicted in FIG. 16. The container 156 includes grooves 166 on opposite sides of the side walls on the inside of the container 156 such that the baffle 168, depicted in FIG. 13, may be inserted into the container 156, to create a container/baffle assembly 186, as depicted in FIG. 15. The baffle 168 is sized and shaped so that, when the baffle 168 is inserted into the container 156, an air and water tight seal 190 is created between the side edges 170 of the baffle 168 and the side walls of the cup 156. However, a gap 190 remains between the bottom edge of the baffle 168 and the base of the cup 156 such that liquid may flow freely beneath the baffle 168. The container 156 also includes a tube 160 attached to the inner side wall of the container 156, tube 160 extending vertically down the side wall of the container 156. The bottom of tube 160 opens near the base of the container 156 and the top of tube 160 opens at the rim of the container 156.

FIG. 14 depicts a lid 170 that includes a circular top wall 172 and an annular side wall 174 that depends downward from the top wall 172 and also extends upward from the top wall 172 to create a drinking lip 176. The top wall 172 contains a drink opening 178 near the periphery of the top wall 172. The top wall 172 also includes vent openings 180 that are located near the periphery of the top wall 172 approximately 90 degrees from the drink opening 178 and adjacent to where the baffle 68 seals against the bottom of the top wall 172, when the lid 170 is attached to the baffle/container assembly 186. The vent openings 180 are on the same side of the baffle 168 as the drink opening 180. The lid 172 also includes a vent opening 187 which is near the periphery of the top wall 172 approximately 180 degrees from the drink opening 178. By locating the vent openings 180 and 182 as described above, beverage within the cup 156 will not spill out the vent openings when the cup 156 is tipped to the drinking position. A curved pipe 184 is attached to the vent opening 182 and extends horizontally on top of the top wall 172 toward the drinking opening 178. This allows vapor being force out the vent opening 182 when the container is tipped from the drinking position back to the level position to be directed toward the users nose. The vent openings 180 may also be ducted (not shown) to direct vapor as desired.

When the lid 170 is attached to the baffle/container assembly 186, as depicted in FIG. 16, the drink opening 178 aligns with the top of the tube 160 and the top wall 172 seals against the top of the tube 160 such that, when the vapor directing beverage container 192 contains liquid and is tipped to the drinking position, only the vapor within the tube 160 is forced out the drink opening 178, thus allowing more vapor to be directed out the vent openings 180.

Figure 17:
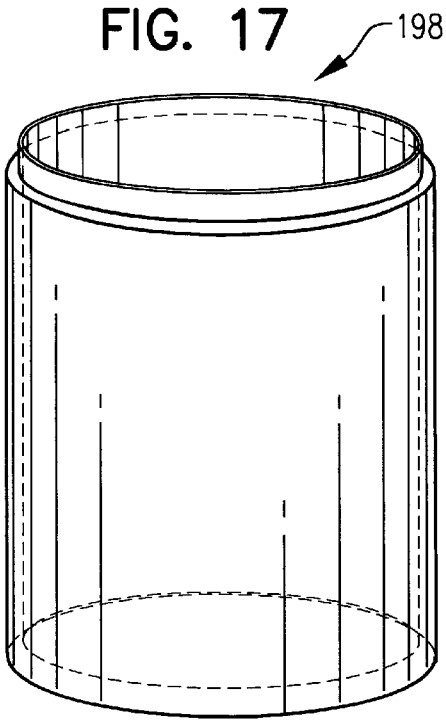
FIG. 17 shows a reusable beverage cup.
Figure 18:
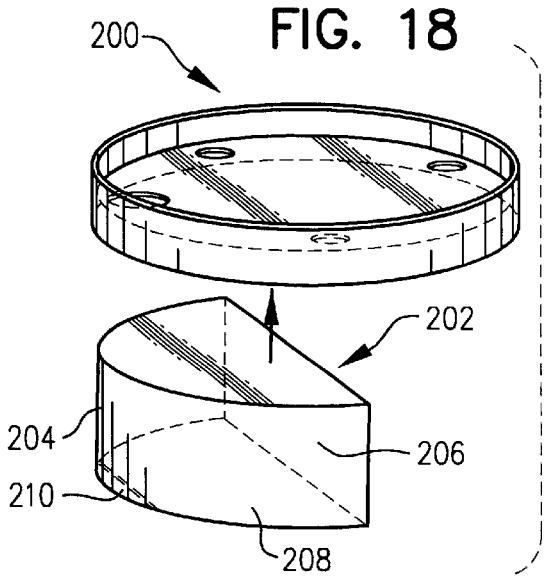
FIG. 18 shows a reusable lid and baffle chamber as separate pieces.
Figure 19:
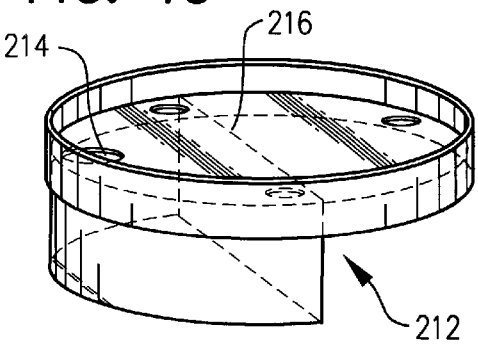
FIG. 19 shows the reusable lid and baffle chamber of FIG. 18 assembled together.
Figure 20:
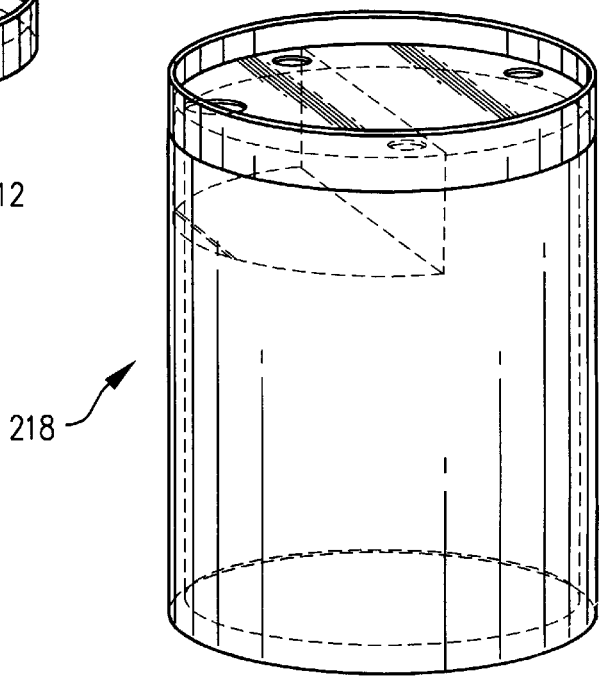
FIG. 20 shows the lid and baffle assembly of FIG. 19 attached to the cup of FIG. 17.

FIG. 17 through FIG. 20 depict another alternative embodiment of the present invention. The container 198 depicted in FIG. 17 is the same as the container 156 depicted in FIG. 12, except that container 198 does not have grooves 166 and does not have a tube 160. The lid 200 is the same as the lid 170 (ducting of the vent openings is not shown). However, in this alternative embodiment, the vertical baffle 168 is replaced with a baffle chamber 202, as depicted in FIG. 18. The baffle chamber 202 includes a curved side wall 204 and a rectangular side wall 206, both side walls extending upward from a baffle base 208. The baffle base 208 has an opening 210 which is directly beneath the drink opening 214 when the baffle chamber 202 is sealably attached 216 to the lid 200, as depicted in FIG. 19. FIG. 20 depicts the lid/baffle chamber assembly 212 removably attached to the container 198. When the vapor directing beverage container 218 contains liquid and is tipped to the drinking position, vapor within the baffle chamber 202 is forced out the vent openings and drink opening as liquid flows into the baffle chamber 202 through the baffle base opening 208.

I claim:

1. A vapor directing beverage container, comprising:

(a) containing means for containing liquid;

(b) covering means for covering said containing means, said covering means sealably attaching to said containing means and having at least a first opening means and a second opening means;

(c) baffle means for dividing said containing means into at least a first chamber means and a second chamber means, said baffle means being shaped and positioned to allow liquid in said containing means to flow freely between each of said chamber means, said baffle means being sealed against said covering means and shaped and positioned to prevent vapor within said first chamber means that is between said covering means and liquid in said containing means from flowing to said second chamber means;

(d) said covering means associated with each of said chamber means having at least a first of said opening means through said covering means, such that, when said containing means contains liquid and is tipped to allow liquid to flow out of at least a first of said opening means in said covering means, vapor within said first chamber means is forced out of at least a first of said opening means associated with said first chamber means, while vapor outside said container means is simultaneously drawn into at least said second chamber means through at least a first of said opening means associated with said second chamber means.

2. A vapor directing beverage container, comprising:

(a) a container for holding liquid;

(b) a lid for sealably covering said container, said lid having at least a first opening and second opening for permitting the passage of liquid or vapor through said lid;

(c) a baffle in said container that seals against said lid, said baffle shaped and positioned within said container to create at least a first chamber and a second chamber, said baffle further shaped and positioned to allow liquid in said container to flow freely between said chambers, said baffle further shaped and positioned to prevent vapor within said first chamber that is between said lid and liquid in said container from flowing to said second chamber; and (d) wherein said baffle is shaped and positioned so that at least one of said openings in said lid is associated with said first chamber and at least one of said openings in said lid is associated with said second chamber, such that when said container contains liquid and is tipped to allow liquid to flow out of at least one of said openings in said lid associated with said first chamber, vapor within said first chamber is forced out of a second one of said at least a first opening in said lid associated with said first chamber while vapor outside said container is simultaneously drawn into said container through at least a first of said openings in said lid associated with said second chamber.

3. The vapor directing beverage container as set forth in claim 2, wherein said lid further comprises:

(a) an annular rim, said annular rim configured to allow said lid to be removably attached to said container;

(b) an annular side wall extending upward from said annular rim;

(c) a circular top wall depending from said annular side wall, said circular top wall having (i) a drink opening adjacent to the periphery of said top wall, (ii) a groove in the bottom surface of said top wall that extends from one edge of said top wall at a point that is about 90 degrees from said drink opening to the opposite edge of said top wall at a point that is also about 90 degrees from said drink opening, said groove allowing said baffle to be removably attached to said lid, (iii) at least a first vent opening adjacent to the periphery of said top wall at a point about 180 degrees from said drink opening, (iv) at least a second vent opening adjacent to said groove and on the same side of said groove as said drink opening.

4. The vapor directing beverage container as set forth in claim 3, wherein said annular side wall is frusto-conical in shape.

5. The vapor directing beverage container as set forth in claim 2 wherein at least one of said openings in said lid associated with said first chamber is ducted, so that the out-flow location of vapor directed through said vent opening is controlled.

6. The vapor directing beverage container as set forth in claim 2 wherein:

(a) said container comprises (i) a base, (ii) side walls extending upwards to a top from said base and cooperating with said base to form a container for holding liquid, (iii) a tube attached to an inner portion of said side walls of said container, said tube extending vertically downward, said tube having a bottom opening and a top opening, said bottom opening located near the base of said container, said top opening located near the top of said side wall; and, (b) wherein said lid comprises (i) a bottom, (ii) at least a first vent opening, one of said at least first vent openings located on the same side of said baffle as said at least a first of said openings in said lid associated with said first chamber, (iii) a means for removably attaching said lid to said container such that when said lid is attached to said container, said at least a first of said openings in said lid associated with said first chamber aligns with said top tube opening (iv) said top tube opening sealing against said bottom of said lid such that when said container contains liquid and is tipped from a level position to a drinking position, only the vapor within said tube flows out said at least a first of said openings in said lid associated with said first chamber, thus allowing more vapor to be directed out at least a first said vent opening.

7. The vapor directing beverage container as set forth in claim 3 wherein:

(a) said container comprises a circular base with side walls extending upwards from said base to a circular rim; and (b) wherein said baffle comprises a vertical extension which, when inserted into said container, seals against said side walls of said container near the diameter of said container; and (c) wherein said drink opening in said lid is near the point along the periphery of said lid which is 90 degrees from the points along said rim of said container where said baffle seals against said container side wall.

8. The vapor directing beverage container as set forth in claim 3 wherein:

(a) said container comprises (i) a circular base wall, and (ii) side walls extending upwards from said base wall to a circular rim;

(b) said lid comprises (i) a horizontal top wall having a top and bottom, (ii) vertical side walls extending downward from said top wall;

(c) said baffle comprising a baffle chamber, said baffle chamber further comprising a horizontal baffle chamber base that is approximately a half circle in shape, said baffle chamber base being sized and shaped to fit within said container and seal against said side walls of said container, and baffle chamber side walls said baffle chamber side walls extending upward from the periphery of said baffle chamber base and sealably attaching to the bottom of said lid;

(d) said baffle chamber base has an opening near the point along the periphery of said baffle chamber base which is 90 degrees from the end points of the straight edge of said baffle chamber base; and (e) said drink opening in said lid is located near the point along the periphery of said lid top wall which is directly above said baffle chamber opening.

* * * * *